United States Patent [19]

Jouanin

[11] Patent Number: 4,709,640

[45] Date of Patent: Dec. 1, 1987

[54] WOODEN MODULAR FURNITURE

[76] Inventor: Pierre Jouanin, 4, allee de la Venerie, Auffargis, Le Peray en Yvelines, France

[21] Appl. No.: 833,835

[22] Filed: Feb. 26, 1986

[51] Int. Cl.[4] ..... A47B 7/02

[52] U.S. Cl. ..... 108/91; 446/124; 108/111

[58] Field of Search ..... 108/91, 111, 114, 64; 211/194, 182; 312/257 SK; 297/440; 446/105, 106, 122, 124, 128, 112

[56] References Cited

U.S. PATENT DOCUMENTS

| | | | |
|---|---|---|---|
| 1,242,273 | 10/1917 | Thurman | 446/105 X |
| 2,915,831 | 12/1959 | Parker | 446/124 X |
| 4,009,665 | 3/1977 | Weisheit | 108/111 |
| 4,091,746 | 5/1978 | Kimbrough | 297/440 X |
| 4,099,472 | 7/1978 | Kellogg | 108/111 X |
| 4,110,052 | 8/1978 | Poluara | 108/111 X |
| 4,193,221 | 3/1980 | Beck | 446/124 X |
| 4,321,873 | 3/1982 | Nealis | 108/91 |

OTHER PUBLICATIONS

Webster New World Dictionary, p. 959, 1968 Edition.

*Primary Examiner*—Peter A. Aschenbrenner
*Attorney, Agent, or Firm*—Karl F. Ross; Herbert Dubno; Andrew Wilford

[57] ABSTRACT

A piece of furniture is formed as a plurality of panels having ends joined together with at least some panels extending perpendicular to and parallel to other panels. Each panel is formed by at least one rectangularly parallepipedal coupling bar having a predetermined length and extending along as respective end of the respective panel. Each such bar has a plurality of like longitudinally extending faces and is formed with a respective longitudinally extending and equispaced succession of like mortises opening perpendicularly at each face. Each panel is also formed by a respective group of like flat slats extending coplanar and parallel to one another and having ends received snugly in the mortises of the respective coupling bar with the slats projecting perpendicularly from the respective bar face. Each end of each slat is cut back to form a tenon complementary to any of the mortises.

8 Claims, 7 Drawing Figures

WOODEN MODULAR FURNITURE

FIELD OF THE INVENTION

The present invention relates to a system for creating modular furniture of wood. More particularly this invention concerns an assembly of elements that can be put together in many different orientations and combinations to produce different pieces of modular furniture.

BACKGROUND OF THE INVENTION

A standard modular shelf arrangement is formed by ladder-like uprights that are connected together by shelves that are normally seated on metal rods fitted into holes in these uprights or they are fixed onto these uprights by means of dovetail formations. By using uprights and shelves of different sizes as well as further accessories like intermediate shelves, doors, drawers and the like it is possible to put together virtually any conceivable type of unit, of virtually any desired height or width. On the other hand such arrangements have the considerable disadvantage that they cannot be extended perpendicularly, and even for a simple setup it is necessary to use a great number of different elements that must be expensively manufactured to high tolerances.

Another known type uses grooved bars that fit together and that can be fitted with thin panels to form box-like shelves. Such arrangements offer very little flexibility and their parts must be made to very close tolerances. Furthermore it is also impossible to extend this type of unit perpendicularly.

The base of another known type of modular furniture is formed by two pairs of panels two of which are provided on at least one of their longitudinal edges with a series of notches so that they can form the uprights of the assembly and two of which are provided at their ends with notches so they can be used as shelves. These notches fit together so that the panels can be locked together and built up into a three-dimensional structure. Such elements must be very carefully manufactured, and also do not permit the piece of furniture to be extended or added to perpendicular to its main direction of elongation.

OBJECTS OF THE INVENTION

It is therefore an object of the present invention to provide an improved assembly of elements for forming a modular piece of furniture.

Another object is the provision of such an assembly of elements for forming a modular piece of furniture which overcomes the above-given disadvantages, that is which uses a minimal number of different parts that can be produced cheaply and that allows the piece of furniture to be extended perpendicularly.

SUMMARY OF THE INVENTION

A piece of furniture according to this invention is formed as a plurality of panels having ends joined together with at least some panels extending perpendicular to and parallel to other panels. Each panel is formed by at least one rectangularly parallepipedal coupling bar having a predetermined length and extending along a respective end of the respective panel. Each such bar has a plurality of like longitudinally extending faces and is formed with a respective longitudinally extending and equispaced succession of like mortises opening perpendicularly at each face. Each panel is also formed by a respective group of like flat slats extending coplanar and parallel to one another and having ends received snugly in the mortises of the respective coupling bar with the slats projecting perpendicularly from the respective bar face.

These panels, which form the basic elements of the furniture, can be assembled easily by hand. The ends of the slats are fitted to the mortises of the coupling bars completely without the use of tools, but the resultant structure is quite solid as the joint is extremely strong. Four sets of slats and four coupling bars can create a simple box that is the basic element of a standard piece of modular furniture. In addition the slats can be used horizontal or vertical and the coupling bars can similarly be adapted to any of the corners of the assembly.

According to another feature of this invention each end of each slat is cut back to form a tenon complementary to any of the mortises. Only these tenons and the respective mortises need be made to very close tolerances; all the other dimensions of the various parts can be quite a bit rougher. In addition the slats can be wide enough to form a fairly continuous surface, leaving webs between adjacent mortises that are sufficiently big to impart quite some strength to the mortise-and-tenon joints.

Complete symmetry of the arrangement is achieved when each coupling bar is of substantially square cross section. In addition the system of this invention can use a third element constituted as a side bar extending parallel to and of generally the same length as the respective coupling bar. Each side bar has one side face formed with a succession of mortises identical to those of the coupling bars and receiving the ends of the respective slats and an opposite side face formed with an oppositely open longitudinal groove complementarily fittable over the longitudinal edge of a slat of another panel. Such a side bar allows a panel to be added to the longitudinal edge of an adjacent panel, with the two panels being coplanar but their slats being perpendicular. For best appearance each side bar has an end projection of generally the same shape as the section of a coupling bar and offset toward the one face of the respective side bar. This projection engages past the end of one of the coupling bars, accurately positioning the side extension and generally dressing up the piece of furniture.

The assembly can also comprise a fourth element constituted as an end bar extending parallel to and of generally the same length as the respective coupling bar. Each end bar is of a thickness equal to the depth of a one of the mortises and is formed with a succession of mortises substantially identical to the mortises of the respective coupling bar. In the simplest possible arrangement the mortises have a depth equal to one-third of the thickness of the coupling bar and the mortises of the end bars are actually throughgoing rectangular holes.

Each of the slat ends, typically formed by a tenon, is slightly oversized relative to the mortises and is force fitted in the respective mortise. Furthermore, the tenons have chamfered longitudinal edges.

In accordance with another feature of this invention all of the slats of a single panel are of the same length, but different panels have slats of different lengths. More particularly each slat has a length 1 between its ends equal to:

$$(N \cdot L) + (N-1)T,$$

where

N=a whole number,

L=a predetermined unit length, and

T=the thickness of the coupling bar measured parallel to the slats. Thus the overall length of a piece of furniture will be equal to $$(N \cdot L)+(N+1)T,$$

since for each slat there is one coupling bar plus one more coupling bar for each side. Such modularity allows the assembly be put together like boxes, but with one side of a given box being formed of one panel of slats and the other by two panels of slats, with perhaps a transverse partition using an end bar. The possibilities are very great.

The modular furniture of this invention can be produced at very low cost. There are no fasteners and the . most complex parts—the coupling bars—can be produced in a factory operation at a very low unit cost. The use of ood produces an attractive end product while allowing, if necessary, minor adjustments to the joints if necessary.

DESCRIPTION OF THE DRAWING

The above and other features and advantages will become more readily apparent from the following, reference being made to the accompanying drawing in which.

SPECIFIC DESCRIPTION

Figure 1:
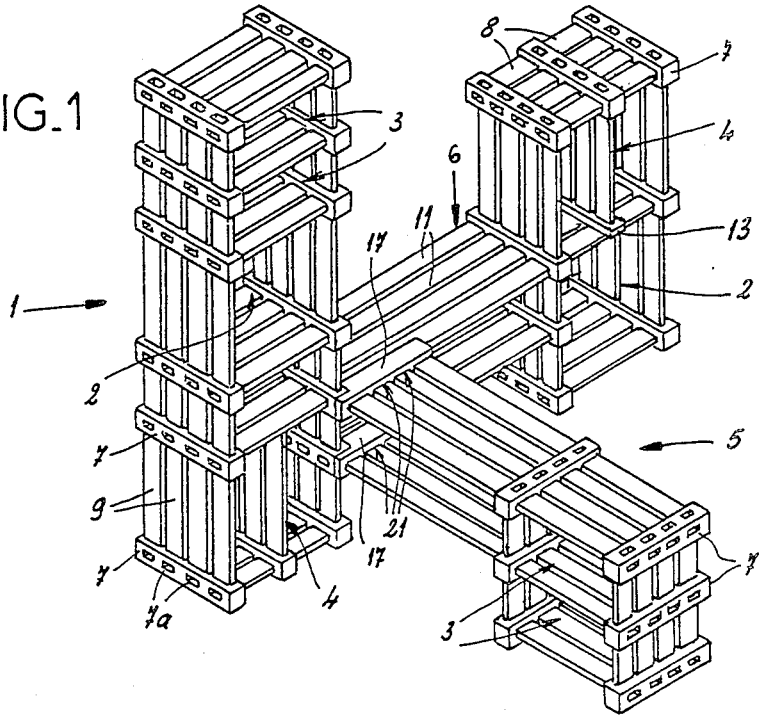
FIG. 1 an isometric view of a piece of furniture according to this invention.

As seen in FIG. 1 a wholly modular piece of furniture 1 forms shelf-type storage spaces 2 that are large and cubic and spaces 3 that are of the same depth but are formed by paritions 4 to be only half as wide or high. In addition the furniture 1 forms a main seat 6 and an outrigger seat 5 extending at a right angle therefrom and supported at its outer end at two more rectangular shelves 3. As will be described below this entire complex piece of furniture is made up of seven different wooden elements—coupling bars 7, slats 8, 9, 10, and 11, side bars 17, and end bars 13—and the slats 8–11 are identical except as to length.

Figure 4:
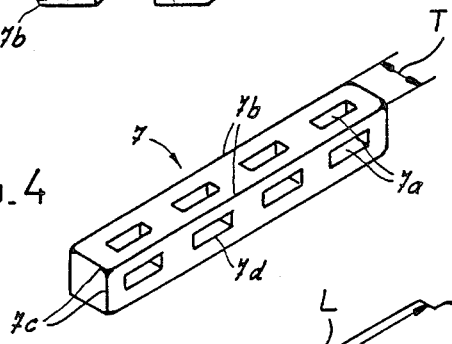
FIGS. 4, 5, 6, and 7 are isometric views respectively of a coupling bar, a slat, a side bar, and an end bar according to this invention.

As best seen in FIG. 4 each coupling bar 7 is of square section and has a thickness T of some 4.7 cm. Each face of the bar is formed with four identical mortises **7*a* which are rectangularly elongated in the longitudinal direction of the bar 7 and which have chamfered edges 7*d*. The longitudinal edges 7*b* and the end edges 7*c* are similarly chamfered so that there are no sharp edges at all on the coupling bars 7. The bar 7 of FIG. 4 has four such mortises 7*a*** equispaced along its length on each of its faces and is 31.5 cm long. A five-mortise bar would have a length of 39 cm.

Figure 5:
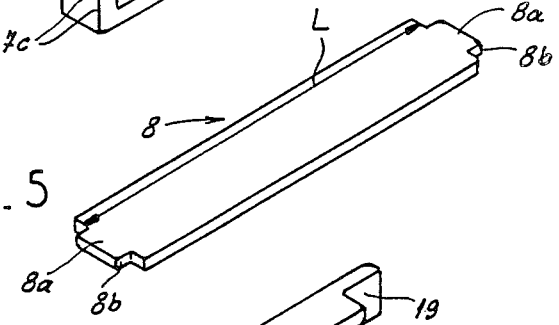

The slats 8, 9, 10, and 11 all have at their ends tenons **8*a*, 9*a*, 10*a***, and ll*a* that are identical and substantially complementary to the mortises **7*a* which are of course all identical. As seen for the slat 8 of FIG. 5 the outer edges 8*b* of the tenon 8*a* are chamfered, as are the edges of the other tenons 9*a*–11*a*. These tenons 8*a*–11*a* are some 0.5 mm larger than the mortises 7*a* for a tight force fit when they are fitted together. The slats 8 have a length L of 14.4 cm and the slats 9, 10, and 11 are respectively 33.5 cm, 52.6 cm, and 71.7 cm long, being modularly increased by 19.1 cm which is the length of one slat 8 plus the thickness T of one slat 7. Hence the overall length of any assembly of slats 8–11 and bars 7** will be equal to $(N \cdot T)+(N-1) \cdot L$, where N is a whole number.

The widths of the slats 8–11 are all identical, here between 6.5 cm and 7.0 cm, and are such that a space of about 1.5 cm is left between adjacent slats. This makes it possible to work to fairly loose tolerances on this dimension, reducing production costs. Of course the slat width could be figured to produce a fairly continuous surface when the slats were put into adjacent mortises, but this would require the slats to be cut to fairly close tolerances, raising production costs.

Figure 2:
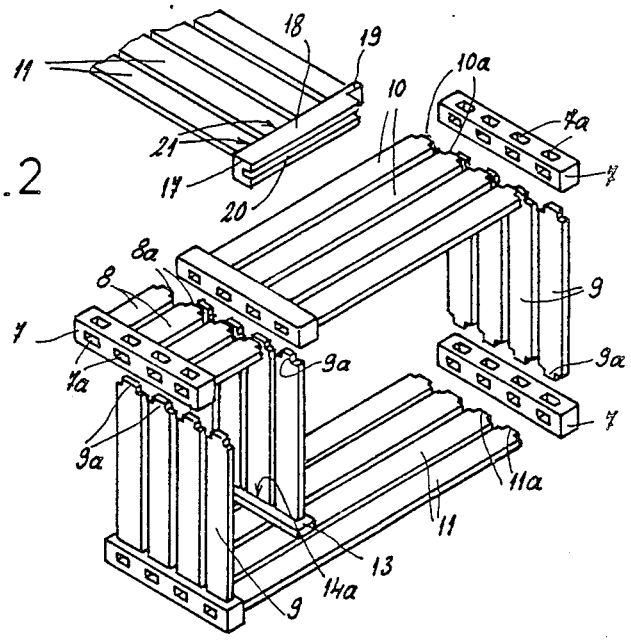
FIG. 2 a large-scale exploded view of a detail of another piece of furniture according to this invention.
Figure 3:
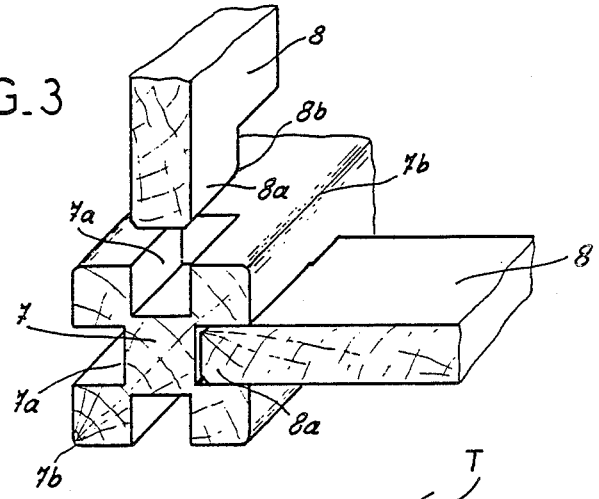
FIG. 3 large-scale section through a joint according to this invention.

The system of this invention further comprises an end bar 13 which basically is identical to one of the coupling bars 7 cut longitudinally into thirds. Thus each end 13 is of the same length as one of the bars 7, has a pair of opposite parallel .aces 14 and 15, and is formed with a row of mortises **14*a* identical to the row of mortises 7*a*. The mortises 14*a* have a depth equal to the longitudinal projection of the tenons 8*a* and in turn equal to T/3 as plainly shown in FIG. 3. Thus as shown in the upper right of FIG. 1 and in the lower left of FIG. 2, when one side of a storage space is formed by two sets of slats joined by a coupling bar 7 and the opposite side of the compartment is formed by a single set of longer slats, it is possible to erect a partition of slats each anchored at one end in the bar 7 of the two-part side and at the other end in a respective mortise 14*a* of a bar 13. SUch an end bar 13** will rest flatly on the longer slats of the opposite side.

Figure 6:
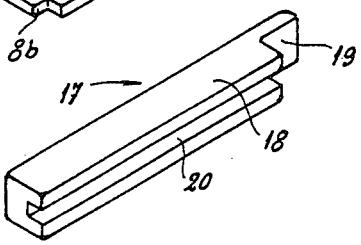
Figure 7:
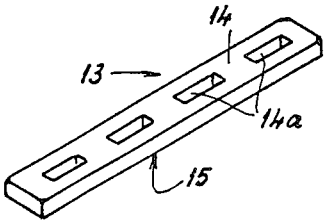

As seen in FIG. 6 the other element used in the furniture 1 is a side bar 17 which has a main portion 18 of a length equal to that of the bars 7 being used and an end tab 19 projecting a length equal to the bar thickness T and having a thickness equal to T/3. One longitudinal face of this bar 17 is formed with a longitudinally extending and laterally open notch 20 of a shape complementary to the longitudinal edge of one of the slats. The opposite face of the bar 17 is formed as only indicated in FIGS. 1 and 2 with a row of mortises 21 identical to the mortises **7*a* and 14*a*. Thus a panel can be formed by fitting a group of the slats into such a bar 17 which can then be fitted to the edge of the slat of another panel. The end tab 19 serves to accurately position the side bar 17 while generally dressing up the assembly. It is therefore possible to produce any shape based on a right angle. FIG. 1 shows a T-shaped piece of furniture 1**, but it would be possible to make the assembly annular or of more complex shape.

Thus the four different elements of the instant invention can be assembled into virtually any desired configuration. The slats are typically sold in groups of four or five, depending on whether four- or five-mortise bars are being used, and the other elements are sold individually. A basic starter kit is also typically marketed which includes enough elements to put together a basic unit that the buyer supplements with individual pieces.

I claim:

1. A piece of modular furniture formed as a plurality of side, top, and bottom panels having ends joined together with the side panels extending parallel to one another and perpendicular to the top and bottom panels and thereby forming therewith a plurality of parallelepipedal compartments in a furniture configuration, each panel being formed by:

at least one rectangularly parallepipedal and wooden coupling bar having a predetermined length and extending along a respective end of the respective panel, whereby each compartment is formed by a plurality of bars of the respective panels, each bar having a plurality of like longitudinally extending faces and being formed with a respective longitudinally extending and equispaced succession of like mortises opening perpendicularly at each face, the bars forming each compartment extending parallel to one another at the corners thereof; and a group of like flat and wooden slats extending coplanar and parallel to one another and having ends received snugly in the respective mortises with the slats projecting perpendicularly from the respective bar face, the slats of each compartment extending perpendicularly between and interconnecting the bars at the corners of the respective compartment, at least one of the panels also comprising a wooden bar extending parallel to and of generally the same length as the respective coupling bar, each side having one side face formed with a succession of mortises identical to those of the coupling bar and receiving the ends of the respective slats and an opposite side face formed with an oppositely open longitudinal groove complementarily fittable over the longitudinal edge of a slat of another panel to join two of said compartments together.

2. The modular furniture defined in claim 1 wherein each end of each slat is formed with a tenon complementary to any of the mortises.

3. The modular furniture defined in claim 1 wherein each coupling bar is of substantially square cross section.

4. The modular furniture defined in claim 1 wherein each coupling bar is of substantially square cross section and each side bar has an end projection of generally the same shape as the section of a coupling bar and offset longitudinally from the side bar toward the one face of the respective side bar.

5. The modular furniture defined in claim 1 wherein at least one of the panels also comprises a wooden end bar extending parallel to and of generally the same length as the respective coupling bar, each end bar being of a thickness equal to the depth of a one of the mortises and being formed with a succession of mortises substantially identical to the mortises of the respective coupling bar.

6. The modular furniture defined in claim 1 wherein each of the slat ends is slightly oversized relative to the mortises and is force fitted in the respective mortise.

7. The modular furniture defined in claim 1 wherein the slat ends are formed with tenons in turn formed with chamfered longitudinal edges.

8. The modular furniture defined in claim 1 wherein all of the slats of a single panel are of the same length, but different panels have slats of different lengths.

* * * * *